United States Patent [19]

Fraige

[11] 4,301,560

[45] Nov. 24, 1981

[54] WATERBED MATTRESS

[76] Inventor: Richard Fraige, P.O. Box 649, Carson City, Nev. 89701

[21] Appl. No.: 107,037

[22] Filed: Dec. 26, 1979

[51] Int. Cl.[3] ..... A47C 27/08

[52] U.S. Cl. ..... 5/450; 5/451; 220/88 R

[58] Field of Search ..... 5/450, 451, 452, 449, 5/484, 448, 474; 220/88 R

[56] References Cited

U.S. PATENT DOCUMENTS

| | | | |
|---|---|---|---|
| 863,783 | 9/1907 | Chace | 220/88 R |
| 2,305,923 | 12/1942 | Held | 220/88 R |
| 2,742,652 | 4/1956 | Mautz | 5/448 |
| 3,206,776 | 9/1965 | Moore | 5/450 |
| 3,585,356 | 6/1971 | Hall | 5/450 |
| 3,663,973 | 5/1972 | Spence | 5/450 |
| 3,864,768 | 2/1975 | Fraige et al. | 5/452 |
| 4,167,795 | 9/1979 | Lambert, Jr. | 5/458 |

*Primary Examiner*—Roy D. Frazier
*Assistant Examiner*—Alexander Grosz
*Attorney, Agent, or Firm*—Jerome N. Field

[57] ABSTRACT

An improved adjustable waterbed mattress with hydrostatic wave absorption comprising a water-inflatable bag-like enclosure containing therein a non-woven or very loosely woven expanded fiber product, unbonded or fixed with a binder to the same or another fiber product, which resists decomposition in water. When a user sits or lies on a conventional waterbed there is a tendency to sink or bottom out especially on the edge and an undesirable wave front is created in the waterbed mattress. The provision of the subject expanded fiber product in the waterbed mattress of the present invention substantially mitigates and dissipates this wave front and allows the bed to be easily packaged, filled, heated, drained and stored.

30 Claims, 6 Drawing Figures

WATERBED MATTRESS

BACKGROUND OF THE INVENTION

This invention relates to waterbeds and, more specifically, to an improved motion-control waterbed mattress. Waterbeds are ordinarily comprised of a rigid frame constructed of suitable plastic or wood supporting a bag-like enclosure which is filled with water through a water-filling means. The frame serves to confine the water-inflatable bag-like enclosure which is ordinarily constructed of vinyl or other suitable watertight flexible sheets.

The waves, the bottoming out and the edge collapsing created by the user's sitting, lying or moving on the waterbed mattress cause discomfort for the user or users thereby discouraging waterbed use. In the past, attempts have been made to suppress this discomfort problem with varying degrees of success. For example, baffles, tie-downs, and floats with tie-downs and/or baffles tied to the underside of the top and/or upper side of the bottom of the bag-like enclosure of the waterbed mattress have been employed to suppress motion. However, these conventional motion suppression means require additional watertight seams at high stress points which eventually fail ultimately resulting in water leakage.

Gelling agents have also been used in the past to suppress undesirable wave motion. But gell presents blending, heating and removal problems, its viscosity varies with the mineral content of differing water supplies employed and, upon its removal, more gelling agent is required to refill the mattress at considerable cost to the consumer.

Plastic foam inserts in the waterbed mattress constitute another approach to the control of undesirable wave motion and bottoming out. But plastic foam is excessively bulky, is difficult to package, handle and ship when disposed within the waterbed mattress, and when appreciably depressed to reduce bulk, it subsequently recovers an undesirably low percentage of its original dimension. Moreover, when the mattress containing foam inserts are water filled, the foam retains air which is extremely difficult to remove from the mattress. Additionally, the foam interferes with heat transfer in the water and acts as a sponge inhibiting water drainage.

SUMMARY OF THE INVENTION

It is a major object of the present invention to inhibit and control undesirable wave movement and to eliminate the tendency to excessively sink or bottom out, especially on the edge, of waterbed mattresses provided with at least one water-filling means. As hereinafter explained, this object is attained by dissipating the energy of the wave front.

Another object of the present invention is to control waves and bottoming out and to provide edge support in waterbed mattresses through an uncomplicated structure without the employment of gell additives or cumbersome plastic foam inserts.

The safety benefits and advantages of the present invention are particularly important. Conventional waterbeds that are intended to inhibit undesirable wave movement are typically provided with baffles, coil tie-downs, plastic foam inserts, gelling agents or like materials or systems to inhibit wave movement. Structures including but not restricted to coil tie-downs and baffles are butt seamed to the surfaces of the outer bag-like enclosure. As the force of the wave strikes these baffles, separators or tie-downs, they resist the wave front and tug against the surfaces to which they are attached by butt seams thereby causing leaks at these seams. These systems must typically inhibit in excess of 1,000 pounds of water from shifting. The resulting stress commonly causes butt seam tear-outs which cannot be patched. These leakage and tear-out problems are eliminated in the present invention wherein a fibrous material is disposed within the waterbed mattress. Instead of the unyielding resistence to the wave front which characterizes baffles, separators, tie-downs and like systems, the fibrous material of the present invention breaks up and dissipates the wave front without undesirable tension by providing a mesh or lattice-like structure. The unyielding tension which typically causes leaks at the butt seams in waterbed mattresses provided with baffles, separators or tie-downs is thereby avoided.

As compared to plastic foam inserts which are difficult to store, heat and drain, the fiber media of the present invention allows the bed to be simply and easily packaged, shipped, water filled, adjusted, air bled, heated, drained and stored.

Additionally, variations of perimeter edge support, bottoming out and bed center support can be controlled by the shaping and positioning of the inner fiber fill and by selection of differing types of inner fiber fill; i.e., more fill proximate to the perimeter of the waterbed provided greater edge support and reduces bottoming out at the parimeter.

Broadly consisered, the improved waterbed mattress of the present invention is disposed in and supported by a rigid frame and is comprised of a water-inflatable bag-like enclosure containing a fibrous material which resists decomposition in water. Typically the water-inflatable bag-like enclosure is constructed of suitable watertight panels. In ordinary construction this bag-like enclosure is provided with a top panel, a spaced-apart bottom panel and one or more edge panels interconnecting the top and bottom panels. However, the invention also encompasses a bag-like enclosure which is constructed with or without separate top, bottom and side panels or constructed with any combination of said panels. The enclosure is also provided with one or more water-filling and valve means.

The fibrous material contained within the water-inflatable bag must resist decomposition in water, and must be a non-woven or very loosely woven expanded fiber product, unbonded or fixed with a binder in structure.

In operation the bag-like enclosure provided with the net-like, thread-like or shredded fibrous structure is filled with water and the water volume adjusted to satisfy the user's preference.

When the user sits, lies or moves on the waterbed mattress the fibrous material or structure breaks up and dissipates the wave front created in the bag-like enclosure because it forms a mesh or lattice-like obstruction to the movement of the water.

Other objects, advantages, benefits and features of the subject improved waterbed mattress with hydrostatic wave absorption not heretofore set forth will be more fully understood from the following detailed description.

DETAILED DESCRIPTION

Figure 1:
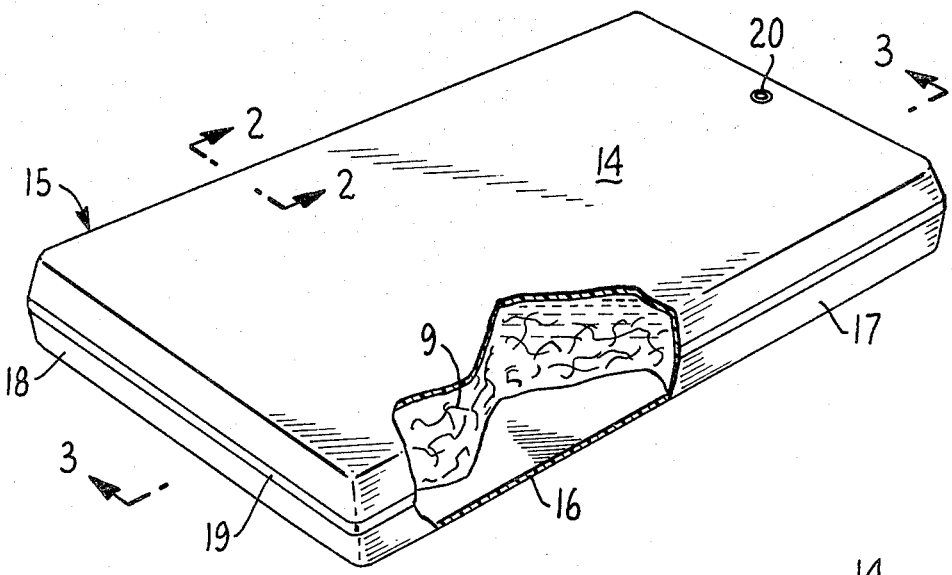
FIG. 1 is a perspective view of waterbed mattress of the present invention with a side panel broken away showing fiber product loosely distributed throughout the bag-like enclosure.

In accordance with the present invention the fibrous material or structure spreads out into the contained water volume. The fibrous material contemplated by the present invention is a non-woven or very loosely woven expanded fiber product or combination of products, each of which is unbonded or fixed with a binder. Examples include, but are not restricted to polyester fibers which are either unbonded or bonded with acrylic resin, either unwoven or very loosely woven. The invention is not restricted to the use of such bonded or unbonded polyester or other man-made fibers. Other suitable fibers, fabric or plastic may be used which resists decomposition in water. Additionally, the material or combination of materials should be highly compressible, i.e., they should compress to at least approximately one-tenth or less of their original dimension and be capable of regaining substantially their entire original size when immersed in water. Thus a typical soft-cell material such as foam or the material known as rubberized horsehair would not prove satisfactory for the purposes of the present invention. The materials contemplated by the present invention should preferably be fibrous, net-like, thread-like or shredded so that air can pass easily through each material's gridwork. This characteristic is particularly important because entrapped air within the waterbed mattress can cause other materials such as conventional foam inserts to float toward the water surface within the waterbed mattress. Materials having a density of about 0.5 to 0.2 pounds per cubic foot, such as bonded or unbonded polyester or other expanded fibers, are appropriate for the purposes of the present invention. Similarly appropriate are fiberglass fibers.

A loose unbonded fiber, such as batting commonly used in pillows, is within the scope of the present invention but is not a preferred embodiment. When such materials are used, the water-filling and water-draining means of the waterbed mattress must be provided with a screen to prevent clogging. Use has shown that loose unbonded fibers are less effective than bonded fibers in bringing about wave reduction. Each of the unbonded fibers has the capability of moving independently within the waterbed mattress causing serious draining problems. Unbonded fibers are also more cumbersome to use in the manufacturing process and in packaging. Additionally, a greater quantity of unbonded fibers must be employed than is necessary with bonded material. The unbonded fibers of the present invention include loose polyester fiber, garnetted polyester fiber and garnetted polyester fiber attached to a skrim.

The inclusion of the material described herein attenuates wave action without appreciably attenuating heat transfer within the waterbed mattress.

In one example the waterbed mattress, 84" long by 72" wide by 9" deep, was provided with three units of non-woven expanded fiberglass material fixed with a phenolic binder. The material was resistant to water decomposition and each unit was 64" long by 64" wide by 2" deep. The units were connected to form a single unit.

In another example, a waterbed mattress 84" long, 72" wide and 9" deep was provided with a polyester bonded media. The material was a non-woven expanded mesh polyester product fixed with acrylic binder. In this example three units of said material, each 64" long, 64" wide and 3" deep, were used. In another example two units of the material were used, each measuring 60" long, 60" wide and 3" deep.

In another example particularly designed to provide edge support for the waterbed mattress user, a waterbed mattress 84" long, 60" wide and 9" deep was employed. The polyester fill which was provided comprised two units each 60" long, 60" wide and 3" deep. The units were connected to form a single unit.

In yet another example, a waterbed mattress 63" long, 45" wide and 5½" deep was provided with a fill comprising four ounds of polyester fiber that was non-woven and unbonded.

In still another example, a waterbed mattress 63" long, 41" wide and 6" deep was provided with three units of a fiberglass fill each 60" long and 40" wide and 2" deep. The units were connected to form a single unit.

In all units the fill formed a mesh-like obstacle in the contained water volume which effectively inhibited and dissipated wave movement.

Figure 2:
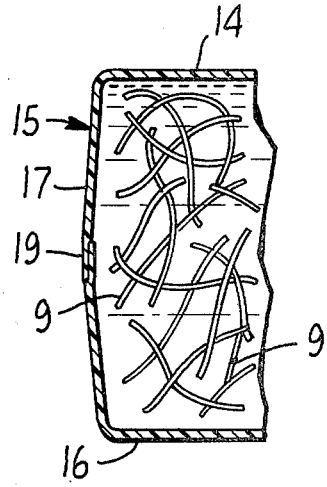
FIG. 2 is a cross-sectional view taken along the lines 2—2 of FIG. 1.
Figure 3:
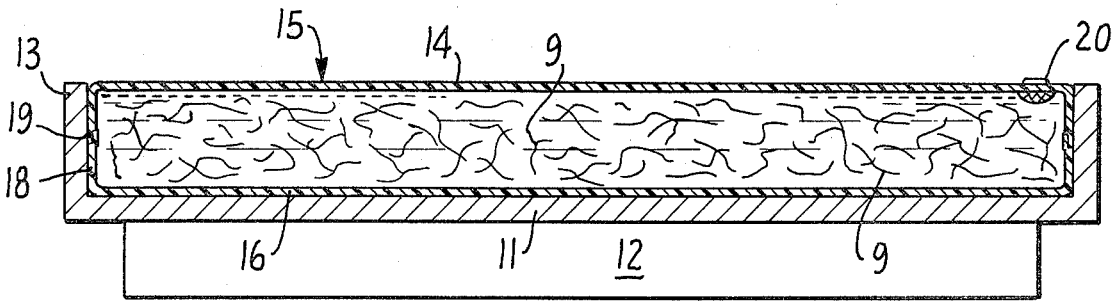
FIG. 3 is a cross-sectional view taken along the lines 3—3 of FIG. 1 and includes the supporting frame.

In the foregoing examples the waterbed mattress is unmodified. However, an alternate embodiment is also encompassed by the present invention. Thus the bag-like enclosure which constitutes the waterbed mattress can be provided with flotation means along its margin thereby providing edge support to the user sitting on the edge of the bed as described in Applicant's U.S. Pat. No. 3,864,768. More specifically, the waterbed mattress can be provided with a peripheral pneumatic float tube, which, when air filled, provides buoyant edge support around the upper periphery of the waterbed mattress. This peripheral pneumatic float tube is provided with an air inflation tube which penetrates the waterbed mattress whereby it may be filled. Turning in detail to the drawings, FIGS. 1, 2 and 3 show a waterbed mattress of the present invention provided with fiber product loosely distributed throughout the mattress. The drawings show relatively even distribution of the fiber product. In operation the fiber product, particularly unbonded fiber product, may be massed or clumped in part and/or form voids in part. As hereinbefore set forth and as demonstrated by the drawings, the present invention includes the employment of unbonded fiber and/or bonded fiber, i.e., fiber fixed with a binder. As previously stated the fiber product, such as that depicted in the drawings, may appropriately have a density of about 0.5 to 0.2 pounds per cubic foot though the invention is not limited to that density. The foregoing weight per unit volume of the body of lofted material is not to be confused with the weight per unit volume of each unlofted fiber taken alone, the binder taken alone or a skrim taken alone. Each of these materials possesses its own distinct weight per unit volume, as distinguished from the weight per unit volume of the body of lofted fibrous material disposed at any desired location within the waterbed mattress to inhibit wave action. When a bonded fiber is used it may be more dense because of the employment of greater quantities of binder. The amount and composition of binder can vary without departing from the scope of the present invention. As also previously indicated, the fibers are expanded i.e., the fibers as used for purposes of the present invention are spaced apart in relation to each other though they randomly touch one another.

I claim:

1. An improved waterbed mattress comprising a water-inflatable bag-like enclosure provided with at least one water-filling means; and an expanded fiber product which resists decomposition in water disposed within said water-inflatable bag-like enclosure forming a mesh-like barrier to wave movement, said mesh-like barrier being highly compressible and capable of regaining substantially its original dimension when immersed in water.

2. The improved waterbed mattress defined in claim 1, wherein said expanded fiber product is non-woven.

3. The improved waterbed mattress defined in claim 1, wherein said expanded fiber product is loosely woven.

4. The improved waterbed mattress defined in claim 1, wherein said expanded fiber product is unbonded.

5. The improved waterbed mattress defined in claim 1, wherein said expanded fiber product is fixed with a binder.

6. The improved waterbed mattress defined in claim 1, wherein said expanded fiber product is a bonded polyester.

7. The improved waterbed mattress defined in claim 1, wherein said expanded fiber product is a fiberglass fiber.

8. The improved waterbed mattress defined in claim 1, wherein said expanded fiber product is a combination of bonded and unbonded fiber.

9. The improved waterbed mattress defined in claim 1, wherein said explanded fiber product is disposed along the periphery of said mattress as a bolster to provide edge support.

10. The improved waterbed mattress defined in claim 1, wherein said expanded fiber product is disposed along the periphery of said mattress as a bolster to provide edge support, as well as throughout said bag-like enclosure.

11. The improved waterbed mattress defined in claim 1, wherein said water-filling means is provided with a filter to prevent clogging by said expanded fiber product.

12. The improved waterbed mattress defined in claim 1, wherein the water-inflatable bag-like enclosure is provided with an air-filled peripheral pneumatic float tube along its periphery.

13. The improved waterbed mattress defined in claim 1, wherein said fiber product has a density of about 0.5 to 0.2 pounds per cubic foot in its original volume.

14. The improved waterbed mattress defined in claim 1, wherein said mesh-like barrier is capable of being compressed to at least approximately 1/10th of its original volume.

15. The improved waterbed mattress defined in claim 1, wherein said expanded fiber product is attached to a skrim.

16. An improved waterbed mattress comprising a water-inflatable bag-like enclosure provided with at least one water-filling means; and an expanded fiber product which resists decomposition in water disposed within said water inflatable bag-like enclosure forming a mesh-like barrier to wave movement, said mesh-like barrier being highly compressible and capable of regaining substantially its original dimension when immersed in water;

said water-inflatable bag-like enclosure contained by a frame.

17. The improved waterbed mattress defined in claim 16, wherein said expanded fiber product is non-woven.

18. The improved waterbed mattress defined in claim 16, wherein said expanded fiber product is loosely woven.

19. The improved waterbed mattress defined in claim 16, wherein said expanded fiber product is unbonded.

20. The improved waterbed mattress defined in claim 16, wherein said expanded fiber product is fixed with a binder.

21. The improved waterbed mattress defined in claim 16, wherein said expanded fiber product is a bonded polyester.

22. The improved waterbed mattress defined in claim 16, wherein said expanded fiber product is fiberglass fiber.

23. The improved waterbed mattress defined in claim 16, wherein said expanded fiber product is a combination of bonded and unbonded fiber.

24. The improved waterbed mattress defined in claim 16, wherein said expanded fiber product is disposed along the periphery of said mattress as a bolster to provide edge support.

25. The improved waterbed mattress defined in claim 16, wherein said expanded fiber product is disposed along the periphery of said mattress as a bolster to provide edge support as well as throughtout said bag-like enclosure.

26. The improved waterbed mattress defined in claim 16, wherein said water-filling means is provided with a filter to prevent clogging by said expanded fiber product.

27. The improved waterbed mattress defined in claim 16, wherein the water-inflatable bag-like enclosure is provided with air-filled peripheral pneumatic float tube along its upper periphery.

28. The improved waterbed mattress defined in claim 16, wherein said fiber product has a density of about 0.5 to 0.2 pounds per cubic foot in its original volume.

29. The improved waterbed mattress defined in claim 16, wherein said mesh-like barrier is capable of being compressed to at least approximately 1/10th of its original volume.

30. The improved waterbed mattress defined in claim 16, wherein said expanded fiber is attached to a skrim.

* * * * *

UNITED STATES PATENT AND TRADEMARK OFFICE

CERTIFICATE OF CORRECTION

PATENT NO. : 4,301,560

DATED : November 24, 1981

INVENTOR(S) : Richard Fraige

It is certified that error appears in the above-identified patent and that said Letters Patent is hereby corrected as shown below:

At column 4, line 49, the word "Turning" should begin a new paragraph.

At column 5, line 11 the following material should be added:

With reference to the perspective shown in Figure 1 and the cross-sections shown in Figures 2 and 3, a waterbed is illustrated having a frame that contains a water-inflatable mattress provided with the subject fiber product 9. The frame includes a floor 11 supported on a base 12 that has vertical side units 13 connected at their ends to form an open box-like structure above the floor 11 of the frame. The floor 11 of the frame is constructed of wood or other appropriate frame material with the side and end units 13 assembled in a conventional manner.

Within this box-like frame structure, the waterbed mattress, generally designated 15, is contained as shown in Figure 3. The waterbed mattress 15 is formed with a rubber or plastic membrane or other appropriate material from which the bag-like water enclosure is fashioned. This bag-like enclosure 15 can be considered as having a horizontal rectangular bottom panel 16 arranged in parallel relationship with the top panel 14 and connected by edge panels. The side panels 17 and end panels 18 connect the peripheral edges of the top and bottom panels to form the water tight bag-like enclosure 15. A side panel 17 and end panel 18, respectively, are customarily formed by extending portions of the top and bottom panels respectively and connecting them by welding or gluing the ends of these It is certified that error appears in the above-identified patent and that said Letters Patent is hereby corrected as shown below:

extending portions in the central area of the side and end panels as illustrated in Figures 1-3 to create a continuous seam 19 about the peripheral vertical sides and ends of the bag-like enclosure 15. This is a desirable arrangement though the invention is not limited to this configuration in creating the bag-like structure 15. A single seam construction 19 such as shown in Figures 1-3 is appropriate for practicing the instant invention. The bag-like structure 15 is also provided with a water filling means 20 in the top panel through which the mattress is water filled. As shown in the drawing the water filling means may if desired be provided with a filter.

Figure 4:
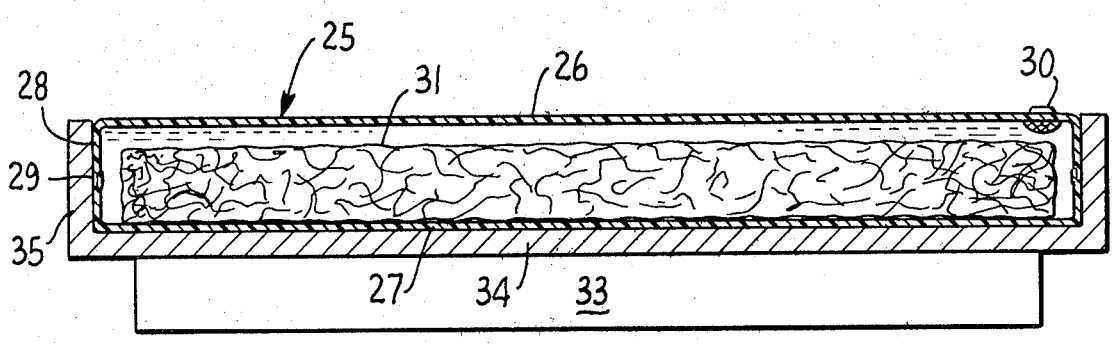
FIG. 4 is a cross-sectional view of a waterbed mattress of the present invention provided with bonded fiber product forming the mesh-like barrier.

Referring to FIG. 4 there is demonstrated a cross-section of an embodiment of a waterbed mattress 25 of the present invention showing the top panel 26, bottom panel 27, and end panels 28 joined by a continuous seam 29. The bag-like enclosure 25 is provided with a water filling means, i.e., plug 30. Disposed within the water-inflatable bag-like enclosure is a bonded fiber product forming the mesh-like barrier 31 of the present invention. The size and shape of barrier 31 may vary considerably without departing from the scope of the present invention. In FIG. 4 the bonded fiber product is shown resting lightly within the bag-like enclosure 25 on the bottom panel 27 and, in ordinary operation can move up, down and laterally. It will be understood, however, that this body of bonded fibers 31 is not restricted to the location shown in FIG. 4, but can be positioned by appropriate means at any location within the It is certified that error appears in the above-identified patent and that said Letters Patent is hereby corrected as shown below:

waterbed mattress. Thus the present invention encompasses the disposition of the fiber product 31 within the water-inflatable bag-like structure 25 without being restricted to positioning of the fiber product 31 at the specific location shown in FIG. 4. The mesh-like barrier of the present invention may also vary in shape and size from that shown in FIG. 4. As shown in FIG. 4 the waterbed mattress 25 is contained in a frame comprised of a base 33, floor 34, end boards 35 and side boards assembled in a conventional manner to form an open box-like structure.

Figure 5:
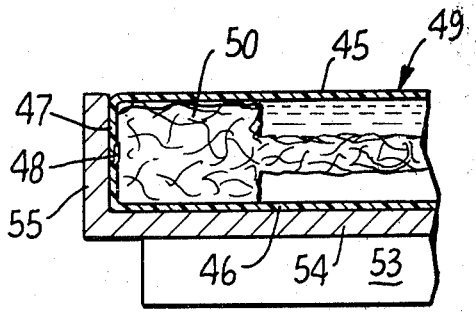
FIG. 5 is a cross-sectional view of a waterbed mattress of the present invention showing the employment of fiber product to provide perimeter edge support.

FIG. 5 is a cross-sectional view of a waterbed mattress of the present invention showing one of the many shapes of the fiber product which can be used to provide perimeter edge support and prevent bottoming out as well as controlling waves. The top panel 45 and bottom panel 46 are joined through the end panel 47 at the continuous seam 48 to form the inflatable bag-like enclosure 49. Fiber product 50 is disposed along the periphery as a bolster to provide edge support. Fiber product 51 is also provided interior to the edges. The shape and size of the bolster 50 can vary without departing from the scope of the invention. Similarly, fiber product 51 can vary in size and shape. The inflatable bag-like enclosure 49 is contained in a frame comprised of a base 53, floor 54, end boards 55 and side boards assembled in a conventional manner to form an open box-like structure.

UNITED STATES PATENT AND TRADEMARK OFFICE

CERTIFICATE OF CORRECTION

PATENT NO. : 4,301,560

DATED : November 24, 1981

INVENTOR(S) : Richard Fraige

Figure 6:
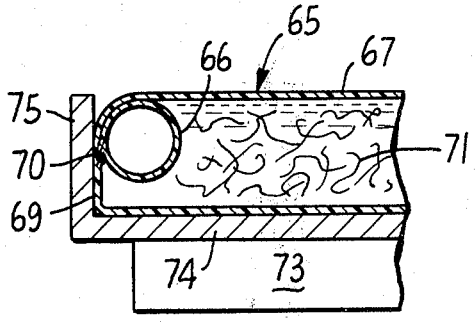
FIG. 6 is a cross-sectional view of a waterbed mattress provided with a peripheral pneumatic float to provide edge support.

It is certified that error appears in the above-identified patent and that said Letters Patent is hereby corrected as shown below:

FIG. 6 is a cross-sectional view of a waterbed mattress 65 of the present invention showing a flotation means 66 along the periphery of the waterbed mattress 65 to provide edge support. The top panel 67 and bottom panel 68 are again joined through the end panel 69 at a continuous seam 70 to form the inflatable bag-like enclosure 65. A pneumatic float tube 66 which, when filled, provides buoyant edge support is disposed around the upper periphery of the waterbed mattress. Its size and shape may vary significantly without departing from the scope of the invention. The waterbed mattress is also provided with fiber product 71 as hereinbefore described. The unit is contained in a frame comprised of a base 73, floor 74, and board 75 and side boards assembled in a conventional manner to form an open box-like structure.

Signed and Sealed this

*Twenty-fifth* Day of *June 1985*

[SEAL]

*Attest:*

DONALD J. QUIGG

*Attesting Officer* *Acting Commissioner of Patents and Trademarks*